US006457429B1

(12) United States Patent
Tomita et al.

(10) Patent No.: US 6,457,429 B1
(45) Date of Patent: Oct. 1, 2002

(54) DISPLAY APPARATUS FOR SEWING MACHINE

(75) Inventors: Shintaro Tomita; Naomi Yamamoto, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 31 days.

(21) Appl. No.: 09/604,417

(22) Filed: Jun. 27, 2000

(30) Foreign Application Priority Data

Jul. 2, 1999 (JP) ..... 11-188898

(51) Int. Cl.[7] ..... D05C 5/02

(52) U.S. Cl. ..... 112/475.19; 112/470.04; 112/102.5; 112/445; 700/138

(58) Field of Search ..... 112/470.04, 470.06, 112/102.5, 445, 475.19, 456, 458; 700/138

(56) References Cited

U.S. PATENT DOCUMENTS

| | | | | | |
|---|---|---|---|---|---|
| 4,184,441 | A | * | 1/1980 | Brown et al. | 112/445 |
| 4,499,836 | A | * | 2/1985 | Meier et al. | 112/445 |
| 5,074,232 | A | * | 12/1991 | Matsubara et al. | 112/445 |
| 5,960,727 | A | * | 10/1999 | Miyasako et al. | 112/102.5 |
| 6,032,595 | A | * | 3/2000 | Okuyama | 112/102.5 |
| 6,167,822 | B1 | * | 1/2001 | Miyasako et al. | 112/102.5 |

* cited by examiner

*Primary Examiner*—Peter Nerbun
(74) *Attorney, Agent, or Firm*—Oliff & Berridge, PLC

(57) ABSTRACT

The display apparatus for a sewing machine of the invention includes a display that displays a stitch pattern thereon, and a sewing order indicator that indicates a sewing order of substantially an entire stitch pattern. Therefore, even when the operator selects, as a stitch pattern, a complex stitch pattern such as a buttonhole stitch pattern, the operator can easily judge if the stitch pattern being sewn is exactly what the operator has selected before the stitch pattern is finished.

33 Claims, 12 Drawing Sheets

DISPLAY APPARATUS FOR SEWING MACHINE

BACKGROUND OF THE INVENTION

1. Field of Invention

The invention relates to a display apparatus for a sewing machine and, more particularly, to technology for displaying the sewing order of a stitch pattern selected from a plurality of sewable stitch patterns.

2. Description of Related Art

A conventional sewing machine with a display displays a plurality of sewable stitch patterns to allow an operator to select a desired stitch pattern therefrom, as a stitch pattern to be sewn, and also displays at least part of the selected stitch pattern to notify the operator of the selected stitch pattern.

As the selected stitch pattern displayed alone on a display does not provide sufficient information about sewing the selected stitch pattern, many of the sewing machines are designed to display more information including the size of the selected stitch pattern (such as the stitch width and the stitch length) and the thread tension during sewing.

As shown in FIG. 12, in a sewing machine the applicants have put to practical use, when a straight stitch pattern key 102 is pressed on a utility stitch pattern selection screen 101 displayed on a display 100, a straight stitch pattern is selected as the stitch pattern to be sewn. At the top of the display 100, a horizontal straight stitch pattern and the stitch pattern name "Straight (Left)" are displayed. Below a plurality of stitch patterns displayed on the display 100, the needle bar oscillating width (stitch width) "0.0 mm", the stitch length "2.5 mm", and the thread tension are displayed as the sewing information of the selected stitch pattern.

In addition, when an "ADVICE" key 104 is pressed on the utility stitch pattern selection screen 101 of FIG. 12, advice on sewing the selected stitch pattern can be displayed on the display 100. If a "HOW TO SEW" key 103 is pressed when the stitch pattern to select is unknown, a sewing position selection screen, a work cloth type selection screen and the like can be displayed on the display 100 to allow an operator to selectively enter the sewing position, the work cloth type, and the like on the respective screens and set a stitch pattern suitable for a particular use.

In some of conventional machines, a selected stitch pattern, sewing information of the selected stitch pattern, such as the pattern size and the thread tension during sewing, and advice on sewing the selected pattern can be displayed. However, to date there is no sewing machine that can display the sewing order of the selected stitch pattern from start to finish of sewing.

The sewing order of relatively simple stitch patterns, such as a straight stitch pattern and a zigzag stitch pattern, is obvious and unnecessary to be displayed. On the other hand, if the sewing order is not displayed on the display when a complex stitch pattern is selected as the stitch pattern to be sewn, an operator cannot check the sewing order of the selected stitch pattern on the display. In this case, it is difficult to judge if the pattern being sewn is the selected pattern by only seeing the pattern being sewn (unfinished pattern). In the worst case, an operator may misjudge that the pattern being sewn is a wrong one and stop sewing.

There is a conventional sewing machine that displays, on a display, a stitch pattern and one arrow indicating the sewing direction at the start of sewing. However, a sewing machine that displays the sewing order of a stitch pattern from start to finish of sewing has not yet been available. In such a conventional machine, it is difficult to judge if the pattern being sewn is the selected one by only seeing the pattern being sewn (unfinished pattern).

When a selected stitch pattern is a continuously- and repeatedly-sewn pattern, it is conceivable to display an essential part, that is, a unit pattern of the selected stitch pattern in an enlarged scale and to show a plurality of needle drop positions of the enlarged unit stitch pattern. However, when a complex stitch pattern is selected, the sewing order is not easy to recognize even if a unit pattern of the selected stitch pattern is displayed in an enlarged scale. Particularly, when the selected pattern is made up of intersecting stitches, the sewing order is more difficult to recognize.

Therefore, the invention provides a display apparatus for a sewing machine that can display the sewing order of a stitch pattern selected from a plurality of sewable stitch patterns to allow an operator to judge if a pattern being sewn (an unfinished pattern) is the selected one, and providing a storage medium storing a stitch pattern display program that enables a display used in a sewing machine to display such sewing order.

SUMMARY OF THE INVENTION

The invention provides a display apparatus for a sewing machine that can indicate a sewing order of substantially an entire stitch pattern using a display.

In this regard, the display apparatus for a sewing machine of the embodiment of the invention may include a display that displays a stitch pattern thereon, and a sewing order indicator that indicates a sewing order of substantially the entire stitch pattern.

According to the display apparatus structured as described above, the sewing order indicator indicates a sewing order of substantially the entire stitch pattern. Therefore, an operator can recognize the sewing order of substantially the entire stitch pattern by means of the display.

In a preferred aspect of the invention, the display apparatus may further include a selecting device that selects the stitch pattern, the display may display the stitch pattern selected by the selecting device, and the sewing order indicator may indicate the sewing order of the stitch pattern selected by the selecting device. According to the display apparatus structured as described above, even when the operator selects, as a stitch pattern, a complex stitch pattern, such as a buttonhole stitch pattern, the operator can easily judge if the stitch pattern being sewn is exactly what the operator has selected before the stitch pattern is finished. Accordingly, the apparatus can prevent the operator from misjudging that a wrong stitch pattern is sewn and from stopping the sewing machine.

In a preferred aspect of the invention, the sewing order indicator may include a sewing direction indicator that indicates a sewing direction at least at a starting portion and an ending portion of the stitch pattern. According to the display apparatus structured as described above, the operator can easily recognize the sewing order of substantially the entire stitch pattern by means of the display.

In a preferred aspect of the invention, the sewing direction indicator may include a mark display device that displays at least one mark indicating the sewing direction. According to the display apparatus structured as described above, the mark display device can indicate the sewing direction in a simple manner.

In a preferred aspect of the invention, the mark display device may display a plurality of marks. According to the display apparatus structured as described above, the mark display device can indicate the sewing direction of substantially the entire stitch pattern in detail.

In a preferred aspect of the invention, the sewing order indicator may include a forming process indicator that indicates a forming process of the stitch pattern. According to the display apparatus structured as described above, the operator can recognize the sewing order of substantially the entire stitch pattern through the forming process of the stitch pattern using the display.

In a preferred aspect of the invention, the forming process indicator may display an animation of the forming process. According to the display apparatus structured as described above, the operator can recognize the realistic image of the forming process of the stitch pattern by the animation displayed on the display.

In a preferred aspect of the invention, the forming process indicator may display each picture included in a series of pictures showing the forming process one by one at intervals of a predetermined period. According to the display apparatus structured as described above, the operator can recognize each step of the forming process of the stitch pattern by the series of pictures displayed on the display.

In a preferred aspect of the invention, the sewing order indicator may include a thread path indicator that indicates a thread path for at least one part of the stitch pattern. Further, the display apparatus may include an enlargement device that enlarges the stitch pattern on the display. Further, the thread path indicator may include a mark display device that displays at least one mark indicating the thread path. According to the display apparatus structured as described above, the operator can easily recognize the stitch pattern enlarged on the display by the enlargement device and the thread path and also the sewing order in detail through the thread path indicated by the thread path indicator.

In a preferred aspect of the invention, the display apparatus may include a needle drop position display device that displays needle drop positions included in the stitch pattern. According to the display apparatus structured as described above, for example, when the fagotting stitch pattern is selected, the displayed needle drop positions of the stitches allow the operator to clearly know the needle drop positions and facilitate the operator to trace a plurality of needle drop positions in the vicinity of a joining part of two work cloths. Thus, workability during sewing can be improved.

In a preferred aspect of the invention, the display apparatus may include a needle drop position numbering device that displays a plurality of numbers indicating an order of the needle drop positions or may include a path numbering device that displays a plurality of numbers indicating an order of the thread path. According to the display apparatus structured as described above, the operator can recognize the sewing order through the numbers indicating the order of the needle drop positions or the thread path on the display.

In a preferred aspect of the invention, the thread path indicator may indicate the thread path for at least one unit of repeated patterns included in the stitch pattern. According to the display apparatus structured as described above, even when a continuous and repeated stitch pattern is selected, the operator can recognize the sewing order of the stitch pattern adequately.

In a preferred aspect of the invention, the thread path indicator may indicate the thread path so that when two stitches cross each other, a lower stitch is not displayed in a vicinity of an upper stitch. According to the display apparatus structured as described above, even when two stitches cross each other in the selected stitch pattern, the operator can recognize the upper/lower positional relationship of the two stitches clearly.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Figure 1:
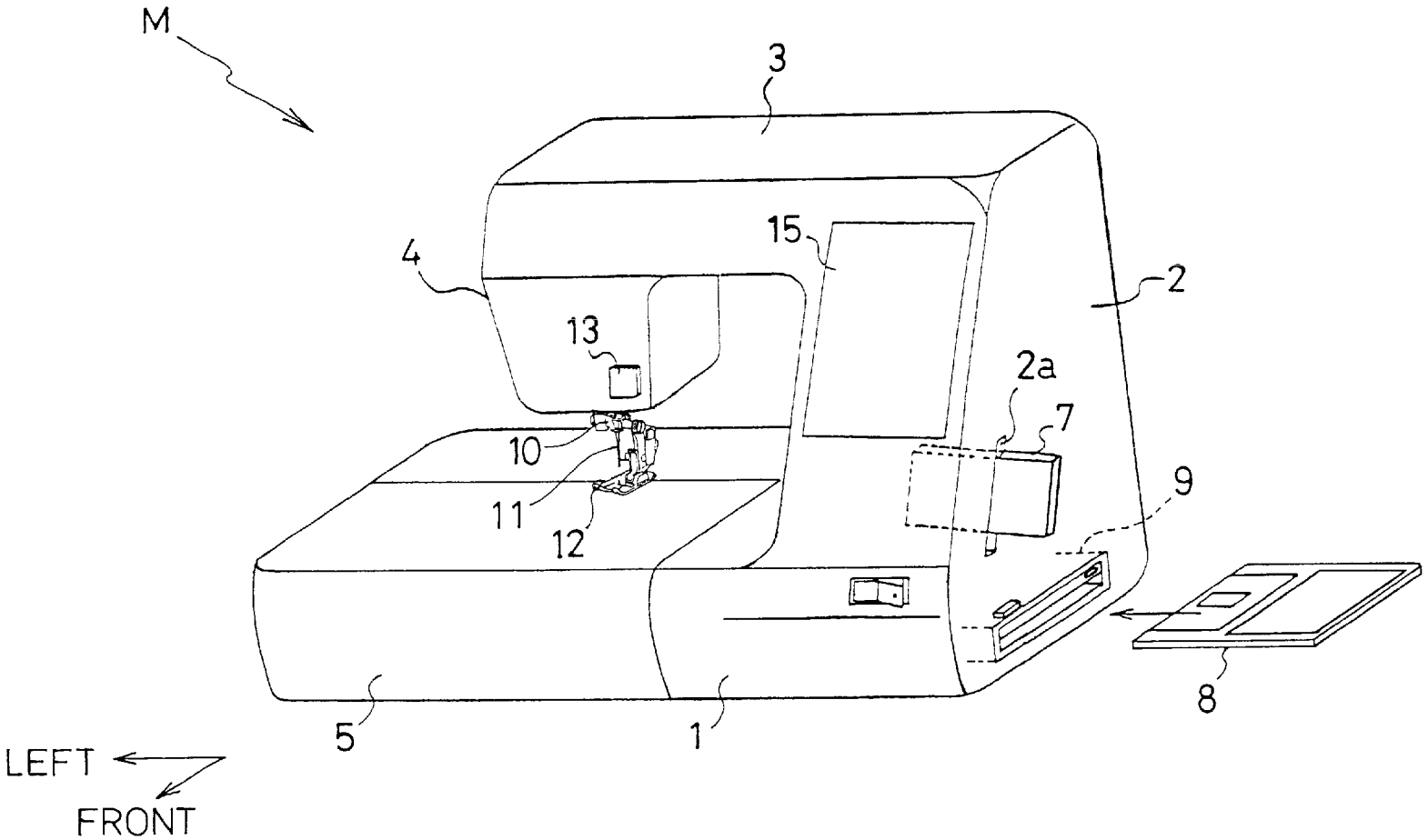
FIG. 1 is a perspective view of an electronically controlled sewing machine according to a preferred embodiment of the invention.

A first preferred embodiment according to the invention as applied to an electronically controlled sewing machine will now be described with reference to the accompanying drawings. The electronically controlled sewing machine has a removable embroidery unit, and can sew embroideries when the embroidery unit is mounted and sew normal stitches (utility stitches, such as straight stitches and zigzag stitches) when the embroidery unit is removed. As shown in FIG. 1, an electronically controlled sewing machine M has a bed 1, a standard portion 2 extending upwardly from the right end portion of the bed 1, an arm 3 extending leftwardly from the top of the standard portion 2 so as to face the bed 1, and a head 4 located at the left end of the arm 3.

The bed 1 is provided with a feed dog (not shown), a feed dog up/down moving mechanism (not shown) that moves the feed dog up and down, a feed dog back/forth moving mechanism (not shown) that moves the feed dog back and forth, and a rotary hook (loop taker) (not shown) that accommodates a bobbin and forms stitches in cooperation with a vertically moving needle 11. When normal stitches are sewn, an auxiliary bed 5 is detachably attached to the bed 1. The embroidery unit 6 (FIG. 2) can be mounted/dismounted to/from the bed 1 when the auxiliary bed 5 is not attached to the bed 1.

Figure 2:
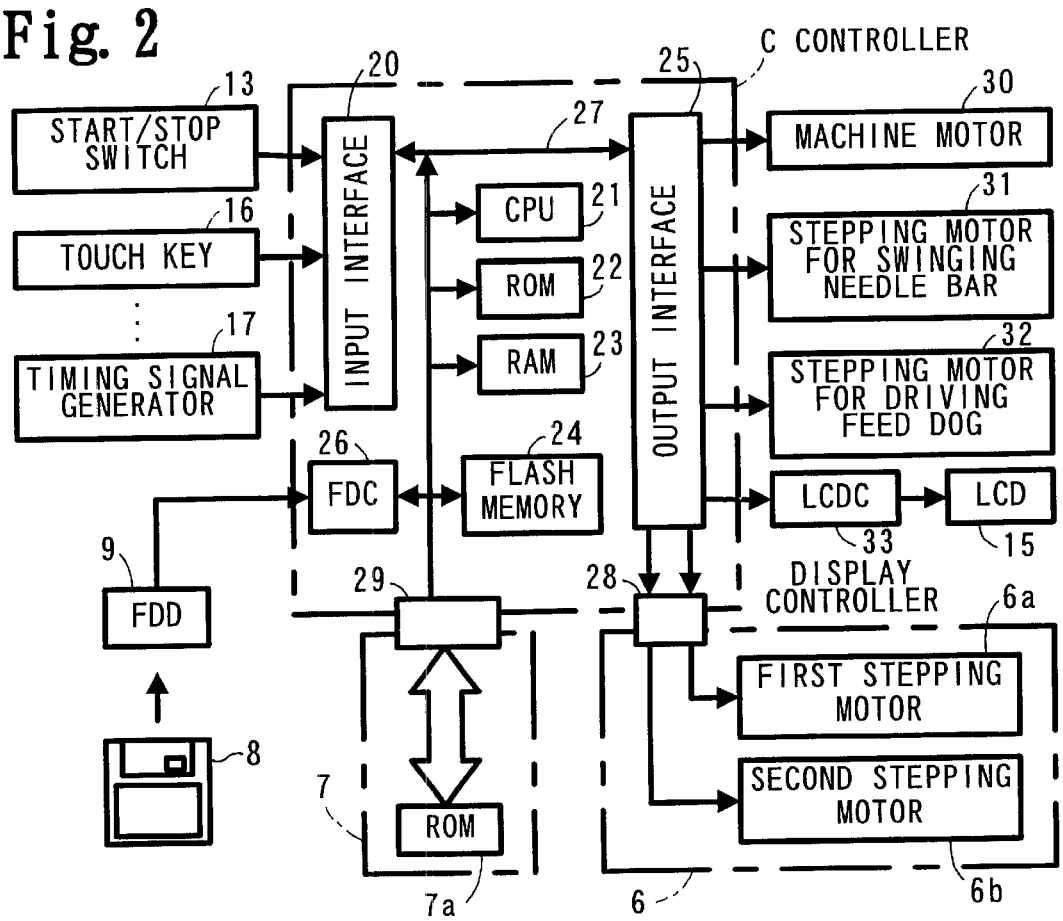
FIG. 2 is a block diagram showing the control system of the electronically controlled sewing machine.

The standard portion 2 has a card slot 2a into which a ROM card 7 is inserted to be connected with an internal card connector 29 (FIG. 2). Below the card slot 2*a,* a floppy disk drive (FDD) 9 for receiving a floppy disk (FD) 8 is built in the standard portion 2. In this embodiment, embroidery pattern data of a plurality of sewable embroidery patterns is stored in the ROM card 7 and the floppy disk 8.

A needle bar 10 is supported on the head 4 so as to be vertically movable. The needle 11 is mounted at the lower end of the needle bar 10. Provided inside the head 4 and the arm 3 are a needle bar driving mechanism (not shown) that vertically moves the needle bar 10, a needle bar oscillating mechanism (not shown) that oscillates the needle bar 10 right and left, and a thread take-up lever driving mechanism (not shown) that vertically moves a thread take-up lever in a timed relationship with the vertical motion of the needle bar 10.

A presser foot 12 is provided to the head 4 so as to press, in the vicinity of the needle 11, a work cloth against the upper surface of the bed 1. A start/stop switch 13 for commanding the sewing machine M to start and stop sewing is provided at the front face of the head 4. The feed dog up/down moving mechanism, the needle bar driving mechanism, and the thread take-up lever driving mechanism are driven by a sewing motor 30, the needle bar oscillating mechanism is driven by a needle bar oscillating stepping motor 31, and the feed dog back/forth moving mechanism is driven by a feed dog back/forth driving stepping motor 32 (FIG. 2).

A vertically elongated color liquid crystal display (LCD) 15 is attached to the front face of the standard portion 2. At the front face of the display 15, a plurality of touch keys 16 (FIG. 2) made of transparent electrodes are arranged in a matrix form. The functions of the touch keys 16 are displayed on the display 15. A desired stitch or function can be selected from the displayed information by pressing the touch key 16 associated with the desired stitch or function.

As shown in FIG. 2, when an embroidery frame (not shown) is mounted on the embroidery unit 6, a first stepping motor 6*a* for driving the embroidery frame in the X direction (right and left direction) and a second stepping motor 6*b* for driving the embroidery frame in the Y direction (back and forth direction) are also mounted thereon. When the embroidery unit 6 is mounted on the bed 1, the first and second stepping motors 6*a*, 6*b* are electrically connected to a control unit C of the sewing machine M through a connector 28.

The control system of the electronically controlled sewing machine M will now be described.

As shown in FIG. 2, the control unit C has a computer including an input interface 20, a CPU 21, a ROM 22, a RAM 23, and a flash memory 24 that is nonvolatile and electrically rewritable, an output interface 25, and a floppy disk controller (FDC) 26 for driving the FDD 9. These devices are connected using a bus 27, such as a data bus.

The start/stop switch 13, the touch keys 16, and a timing signal generator 17 that detects rotation phases of a main shaft of the sewing machine M are connected to the input interface 20. The motors 30–32 and a display controller (LCDC) 33 for the LCD 15 are connected to the output interface 25. The first and second stepping motors 6*a*, 6*b* of the embroidery unit 6 are connectable to the output interface 25 through the connector 28, and a ROM 7*a* of the ROM card 7 is connectable to the bus 27 through a connector 29.

Figure 3:
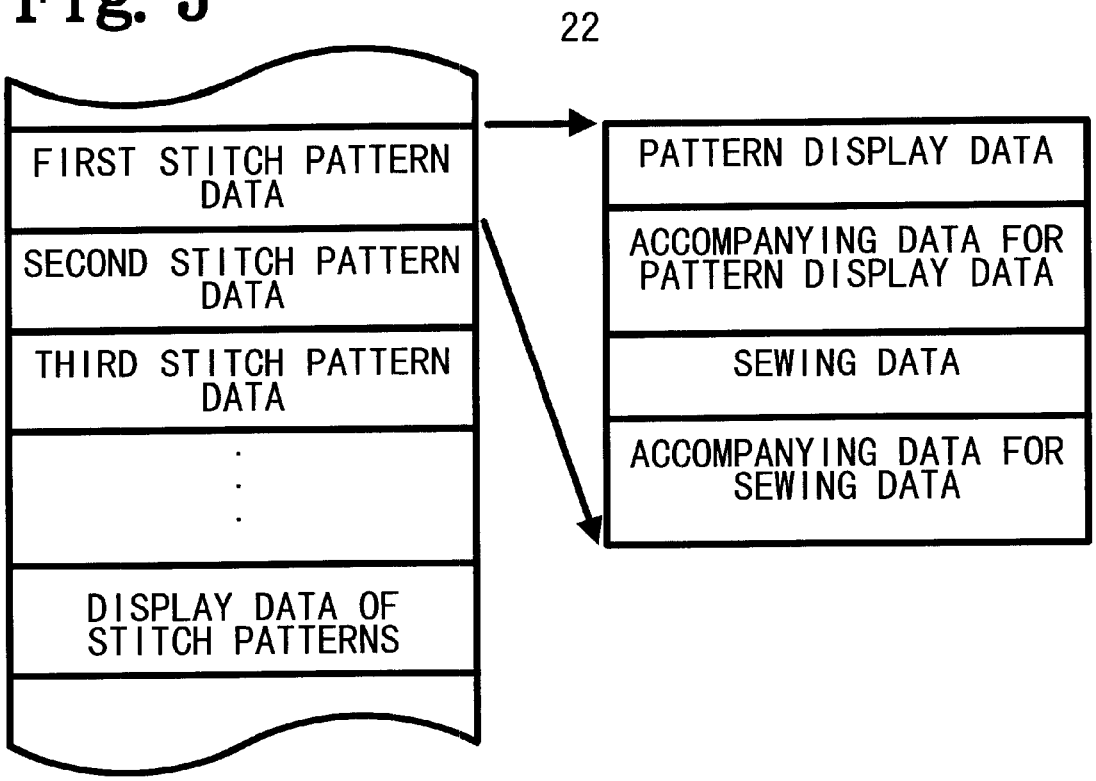
FIG. 3 is a diagram showing the structure of part of the data contained in a ROM.

As shown in FIG. 3, the ROM 22 stores pattern data of a plurality of utility stitch patterns (first stitch pattern, second stitch pattern, third stitch pattern, . . . ) including straight stitches, buttonhole stitches used to form a buttonhole, and fagoting stitches used to join two work cloths.

The pattern data of each stitch pattern includes pattern display data, accompanying data for pattern display data, sewing data, and accompanying data for sewing data. As shown in FIG. 3, the ROM 22 also stores display data of a set of stitch patterns for displaying the stitch patterns at a time. Such a display allows an operator to select a desired stitch pattern from the plurality of stitch patterns. In addition, the ROM 22 stores pattern data of a plurality of embroidery patterns.

Further, the ROM 22 stores a pattern display program, which is unique to the invention, and other programs. The pattern display program includes a pattern display routine for displaying the plurality of stitch patterns on a screen (a pattern selection screen 40 of FIG. 4) of the display 15, based on the display data of a set of stitch patterns, a pattern selection routine for selecting a desired stitch pattern from the plurality of stitch patterns displayed, by the pattern display routine, on the screen of the display 15, and a sewing order display routine for displaying the selected stitch pattern and its sewing order on a screen (a pattern confirmation screen 50 of FIG. 5) of the display 15, based on the pattern display data and the accompanying data for pattern display data (FIG. 3).

Figure 5:
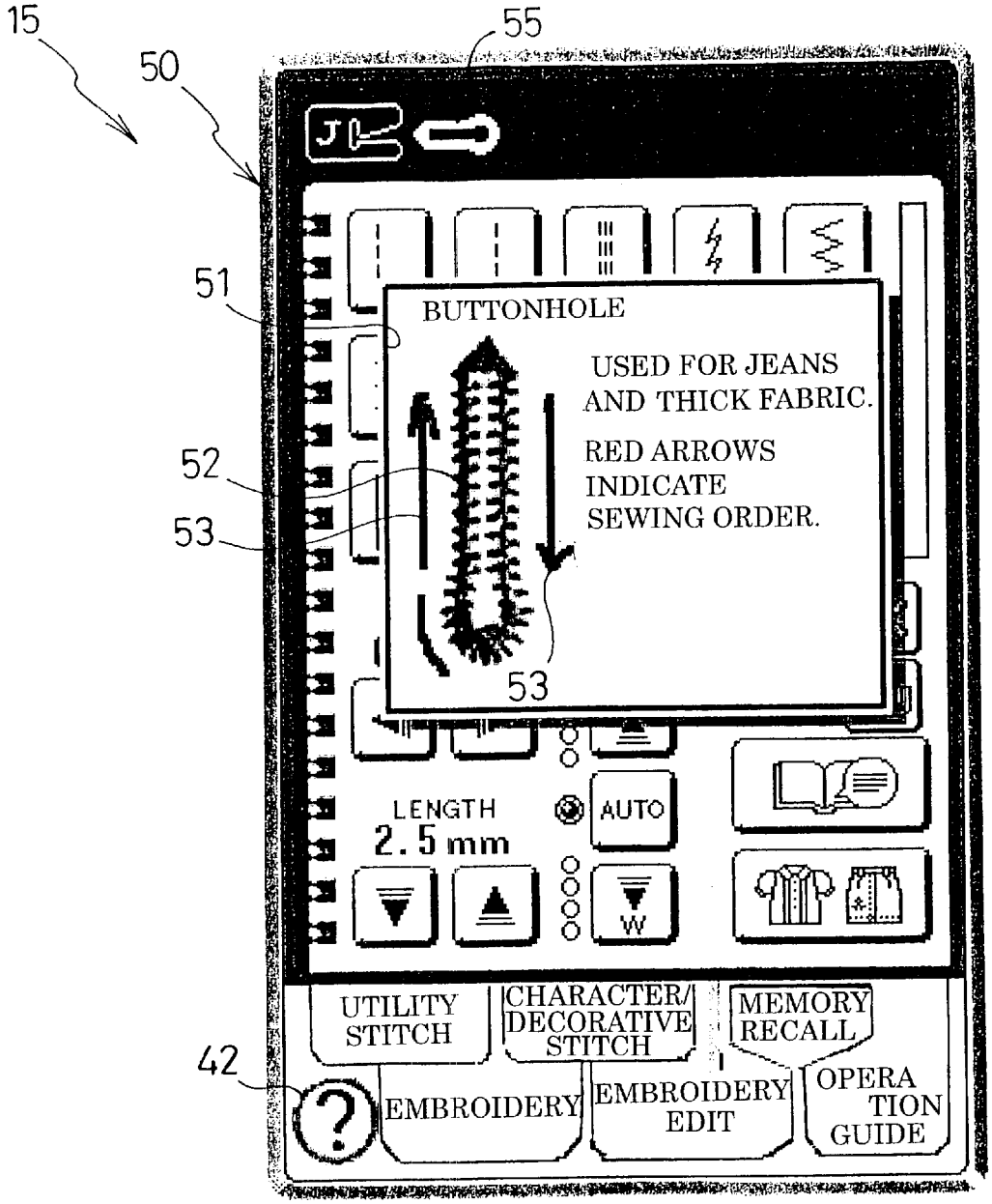
FIG. 5 is a pattern confirmation screen displayed on the display.

Particularly, in this embodiment, as shown in the pattern confirmation screen 50 of FIG. 5, when buttonhole stitches are selected, for example, buttonhole stitches 52 as well as a plurality of arrows indicating the sewing direction are displayed by the sewing order display routine.

A control sequence including a control routine executed by the pattern display program run by the control unit C will now be described with reference to flowcharts shown in FIGS. 6 and 7. An exemplary case will be described where a pattern of buttonhole stitches for forming a buttonhole is selected from the plurality of stitch patterns. Si (i=1, 2, 3 . . . ) shown in the flowcharts represents each step.

Figure 6:
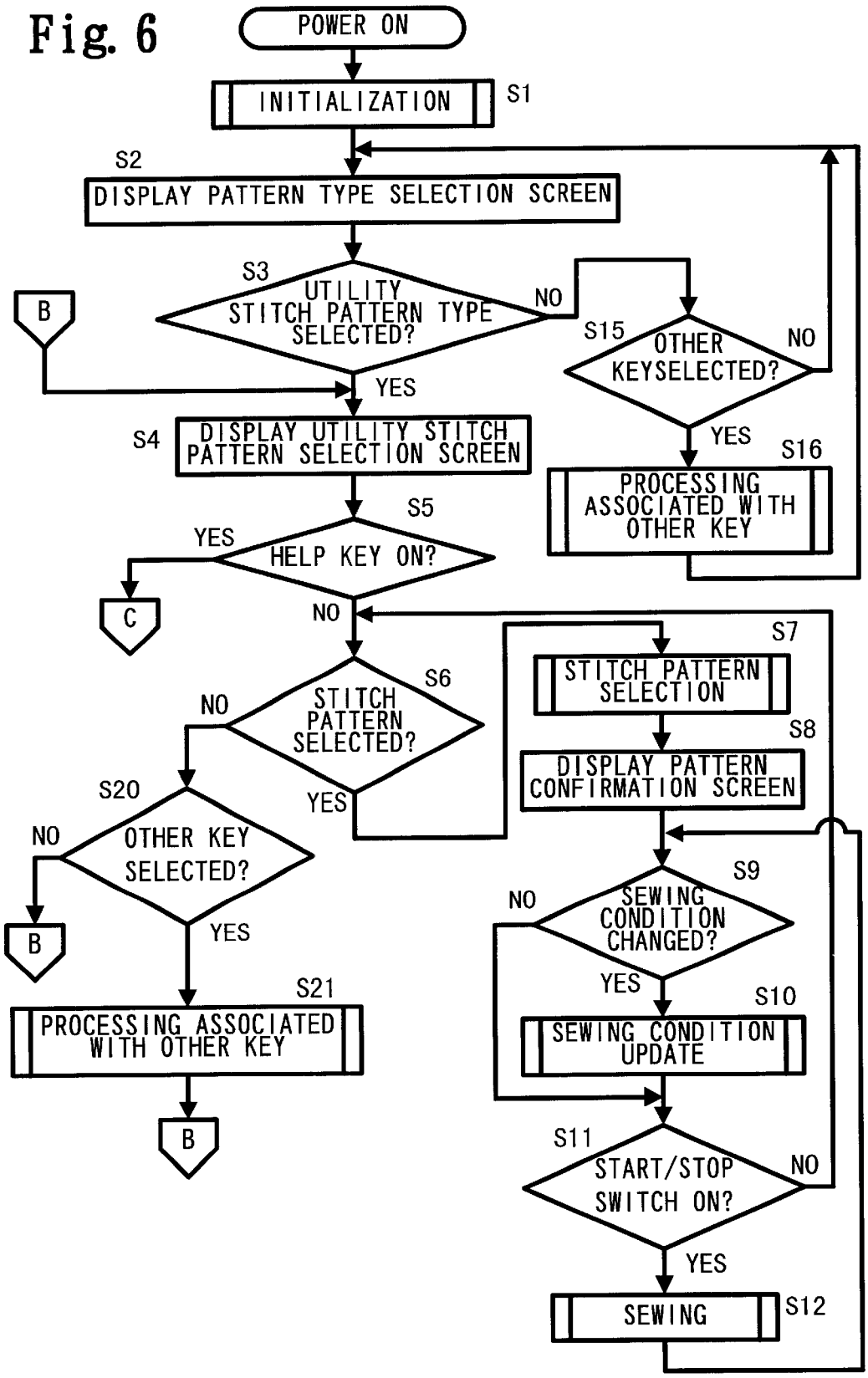
FIG. 6 is a flowchart (first half) of a control sequence including pattern display control.
Figure 7:
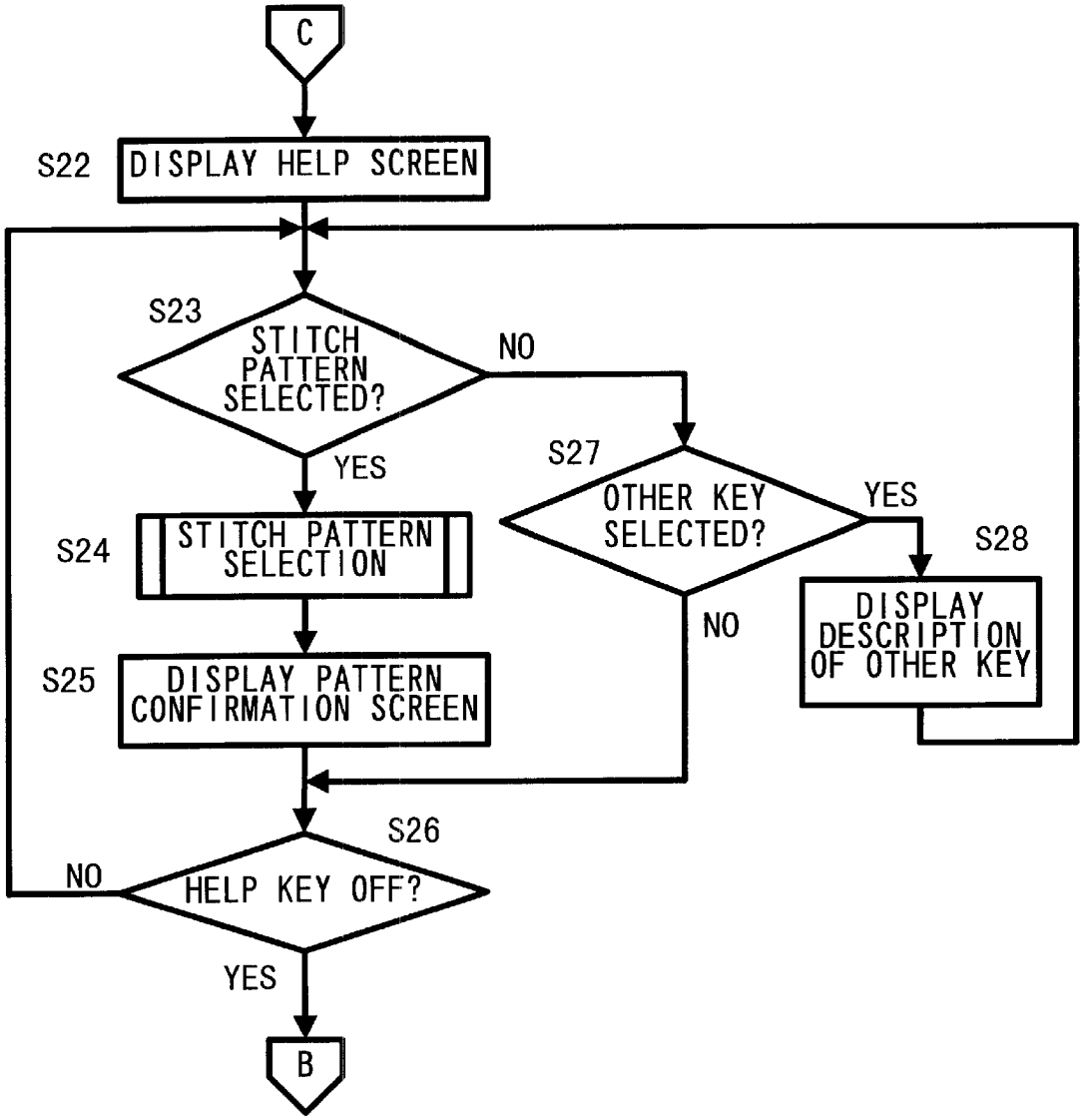
FIG. 7 is a flowchart (second half) of the control sequence including pattern display control.

As shown in FIG. 6, the control sequence starts when the power of the sewing machine M is turned on, and initialization of the sewing machine M including clearing memories in the RAM 23 is executed (S1). Then, when the embroidery unit 6 is not mounted on the sewing machine M, a pattern type selection screen (not shown) appears on the display 15 to allow an operator to select the type of stitch pattern (S2).

When utility stitches are selected as the stitch pattern type by pressing a utility stitch pattern selection key (S3: Yes), the pattern selection screen 40 appears on the display 15 (S4). On the pattern selection screen 40, a plurality of stitch patterns (for example, 15 stitch patterns), including straight stitches, buttonhole stitches, and fagoting stitches, are displayed in a plurality of columns and rows (for example, in a 3×5 matrix), based on the display data of a set of stitch patterns.

In addition, below the plurality of stitch patterns on the pattern selection screen 40, sewing information including the stitch width (WIDTH), the stitch length (LENGTH), and the thread tension (TENSION), along with stitch width changing keys 44*a*, 44*b*, stitch length changing keys 45*a*, 45*b*, and thread tension changing keys 46*a*, 46*b* are displayed. Below them, a help key 42 is displayed.

Figure 4:
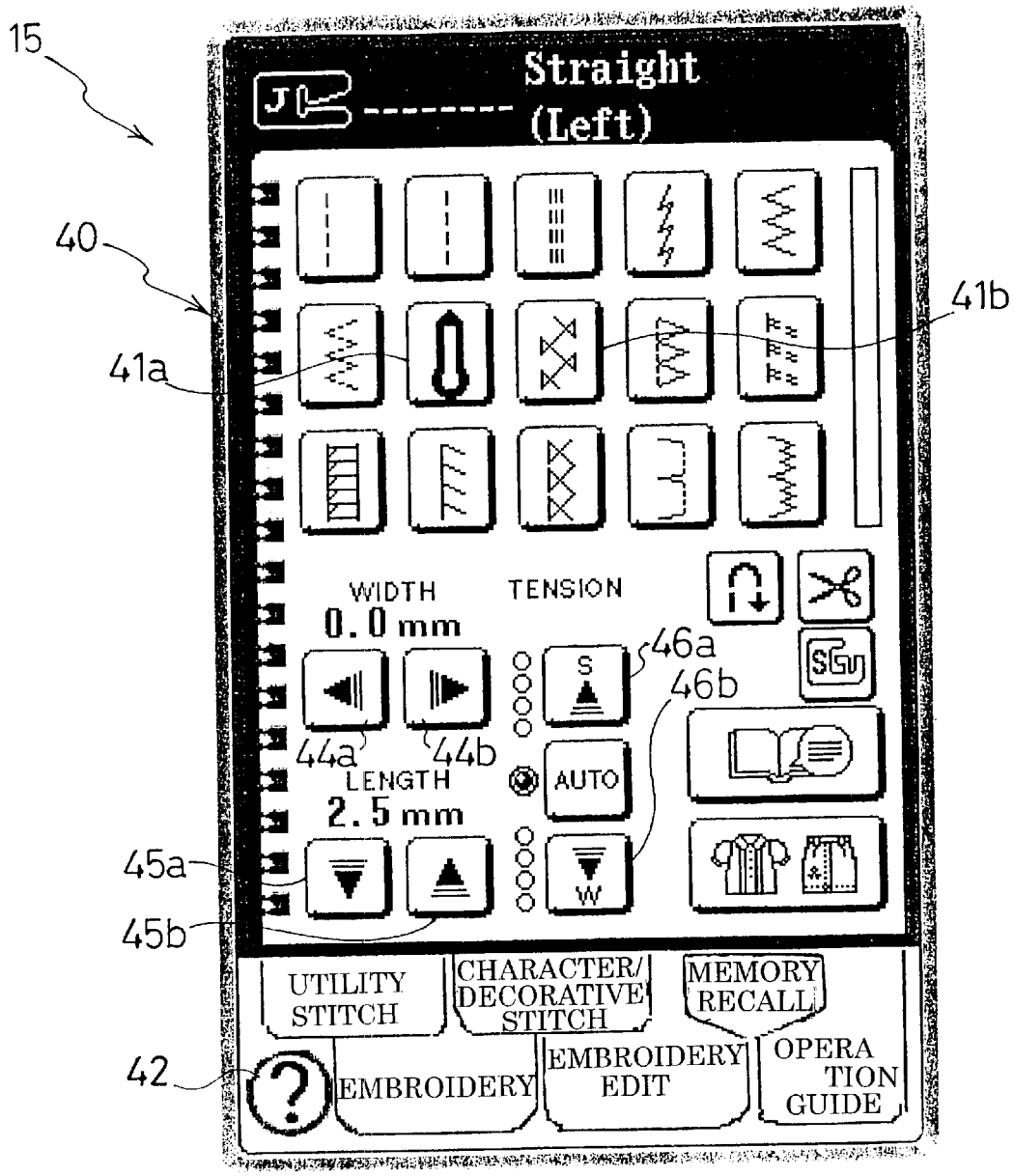
FIG. 4 is a pattern selection screen displayed on a display.

When the pattern selection screen 40 is displayed for the first time after the power of the sewing machine M is turned on, straight stitches are initially selected, as shown in FIG. 4, and a horizontal straight stitch pattern and the stitch pattern name "Straight (Left)" are displayed at the top of the display 15. In addition, the sewing information, that is, the stitch width (WIDTH) being "0.0 mm", the stitch length (LENGTH) being "2.5 mm" and the thread tension (TENSION) are displayed below the plurality of stitch patterns, based on the additional sewing data about straight stitches.

When a buttonhole key 41*a* is pressed on the pattern selection screen 40 while the help key 42 is not on (S5: No), buttonhole stitches are selected as the stitch pattern used for sewing (S6: Yes). After that, when a predetermined key is operated, stitch pattern selection processing (S7) is executed, and then the pattern confirmation screen 50 shown in FIG. 5 is displayed (S8).

On the pattern confirmation screen 50, a pattern display area 51 is displayed so as to overlap a generally central part of the pattern selection screen 40. In the pattern display area 51, a buttonhole stitch pattern 52 is displayed based on the pattern display data, and a plurality of arrows 53 are displayed, based on the accompanying data for pattern display data, to indicate the sewing direction of the buttonhole stitch pattern 52.

In the pattern display area 51, the stitch pattern name "Buttonhole" is displayed above the buttonhole stitch pattern 52, and a piece of advice on sewing and an explanation of the sewing order, which start with "Used for jeans and thick fabric . . . " are displayed on the right side of the buttonhole stitch pattern 52. Together with the pattern selection screen 40 of FIG. 4 and the pattern confirmation screen 50 of FIG. 5, a horizontal buttonhole stitch pattern 55 is displayed outside the pattern display area 51, that is, at the top of the display 15.

At this time, if a predetermined key is operated, the pattern display area 51 disappears. In this state, if any one of the WIDTH changing keys 44*a*, 44*b*, the LENGTH changing keys 45*a*, 45*b*, and the TENSION changing keys 46*a*, 46*b* is pressed to change the sewing condition (S9: Yes), sewing condition update is executed (S10) to change the previously set sewing condition to the newly set sewing condition.

After that, when the start/stop switch 13 is turned on (S11), sewing is executed (S12). The motors 30–32 are driven, based on the sewing data of the selected buttonhole stitch pattern and the above-described sewing condition, and a buttonhole pattern is sewn on a work cloth set on the bed 1. Then the control sequence returns to S9.

When no utility stitch pattern is selected in S3 (S3: No) and any key other than a utility stitch pattern selection key is pressed (S15: Yes), processing associated with the other key is executed (S16), and the control sequence returns to S2. When no stitch pattern is selected (S6: No) and any other key than a stitch pattern selection key is pressed (S20: Yes), processing associated with the other key is executed (S21), and the control sequence returns to S4. When no other key is pressed (S20: No), the control sequence also returns to S4.

When the help key 42 is pressed and turned on in S5 (S5: Yes), the help screen is displayed as shown in the flowchart of FIG. 7 (S22). The help screen is the same as the pattern selection screen 40 except that it is entirely shaded to inform the operator the system is in the help mode. When the buttonhole key 41*a* is pressed on the help screen to select the buttonhole stitch pattern (S23), stitch pattern selection is executed (S24). Then, a pattern confirmation screen, which is substantially the same as the pattern confirmation screen of FIG. 5, is displayed (S25). Doing so allows the operator to review the stitch without actually making a selection, thereby determining the best stitch for the job.

When any other key than the buttonhole key 41*a* is pressed on the help screen (S23: No, S27: Yes), a description of the other key is displayed (S28), and the control sequence returns to S23. Then, when the help key 42 is pressed again and turned off (S26: Yes), the control sequence returns to S4.

As described above, when an operator selects, as a stitch pattern, a complex stitch pattern such as a buttonhole stitch pattern, a plurality of arrows indicating the sewing direction of the stitch pattern are displayed. Such display allows the operator to know the sewing order of the stitch pattern and to judge if the stitch pattern being sewn is exactly what he/she has selected even when the stitch pattern is unfinished, and prevents the operator from misjudging that a wrong stitch pattern is being sewn and stop the sewing machine M.

The above-described pattern display routine corresponds to S2 and S21, the pattern selection routine corresponds to S7 and S24, and the sewing order display routine corresponds to S8 and S25.

Figure 8:
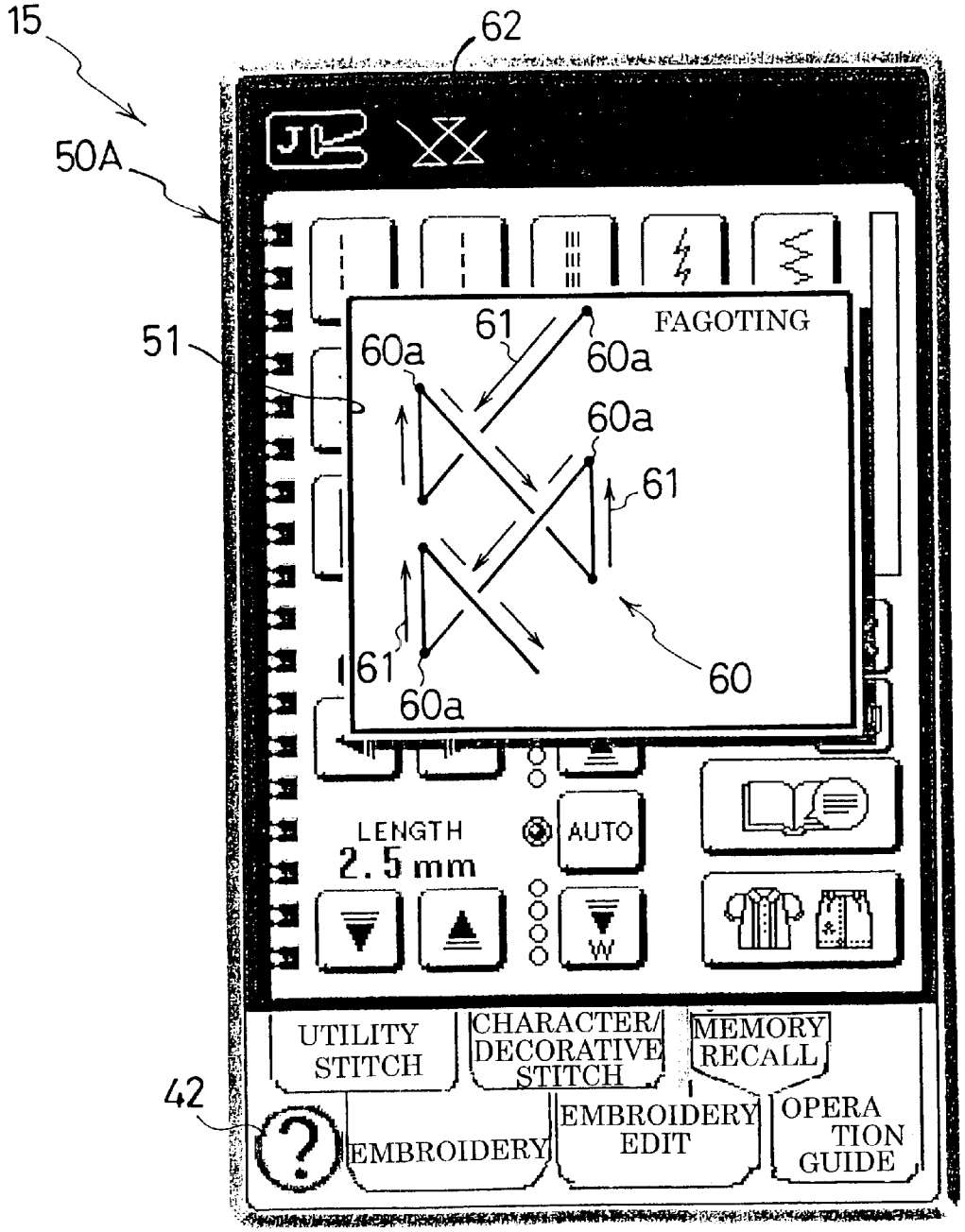
FIG. 8 is a pattern confirmation screen displayed on a display according to a second embodiment of the invention.

Referring now to FIG. 8, a second embodiment of the invention will be described.

The sewing order display routine in the first embodiment may be modified such that stitches in an enlarged scale (hereinafter referred to as enlarged stitches) of an essential part, that is, a unit pattern of a selected stitch pattern, a plurality of arrows indicating the thread path, and needle drop positions of the enlarged stitches may be displayed. Further, when stitches cross each other, the lower stitch may not be displayed in the vicinity of the upper stitch so as to make clear the upper/lower positional relationship of the crossed stitches.

For example, when a fagoting key 41*b* is pressed on the pattern selection screen 40 (FIG. 4) displayed on the display 15, a fagoting stitch pattern is selected and a pattern confirmation screen 50A is displayed as shown in FIG. 8. On the pattern confirmation screen 50A, enlarged stitches 60 of an essential part, that is, a unit pattern of the fagoting stitch pattern, a plurality of arrows 61 indicating the thread path, and needle drop positions 60*a* of the enlarged stitches are displayed based on the pattern display data.

The arrows 61 displayed to indicate the thread path of the enlarged stitches 60 allow an operator to clearly know the sewing order of the selected fagoting stitch pattern. The additionally displayed needle drop positions 60*a* of the enlarged stitches allow the operator to clearly know the needle drop positions 60*a* and to enable the operator to trace a plurality of needle drop positions 60*a* in the vicinity of an joining part of two work cloths. Thus, workability during sewing can be improved.

When stitches cross each other, the lower stitch is not displayed in the vicinity of the upper stitch. Such a display makes clear the upper/lower positional relationship of the crossed stitches. In addition, the stitch pattern name "Fagoting" is displayed in the pattern display area 51 of the pattern confirmation screen 50A of FIG. 8, and a horizontal fagotting stitch pattern 62 is displayed outside the pattern display area 51, that is, at the top of the display 15.

Figure 9:
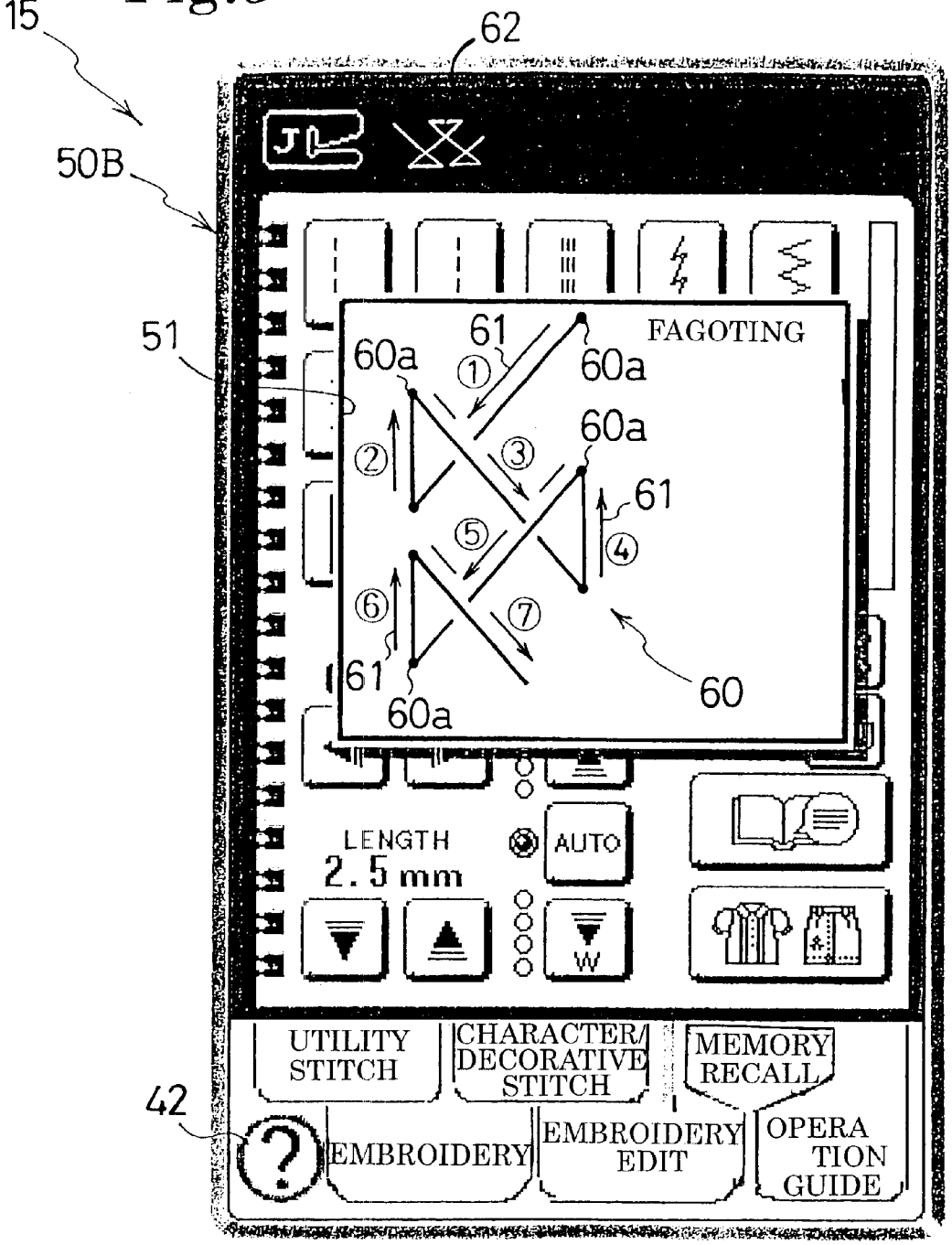
FIG. 9 is a pattern confirmation screen displayed on a display according to a third embodiment of the invention.

Referring now to FIG. 9, a third embodiment of the invention will be described.

The sewing order display routine in the first embodiment may be modified such that a plurality of arrows indicating the thread path of enlarged stitches of an essential part, that is a unit pattern of a selected stitch pattern, and a plurality of numbers indicating the order of sewing along the thread path are displayed. For example, when a fagoting stitch pattern is selected, a plurality of arrows 61 indicating the thread path of enlarged stitches 60 of an essential part, that is, a unit pattern of the fagoting stitch pattern, and a plurality of numbers "1, 2, 3, . . . " associated with the arrows 61 are displayed on a pattern confirmation screen 50B as shown in FIG. 9. Accordingly, the sewing order of the fagoting stitch pattern can be displayed clearly. Alternatively, the plurality of arrows 61 may be omitted.

Figure 10:
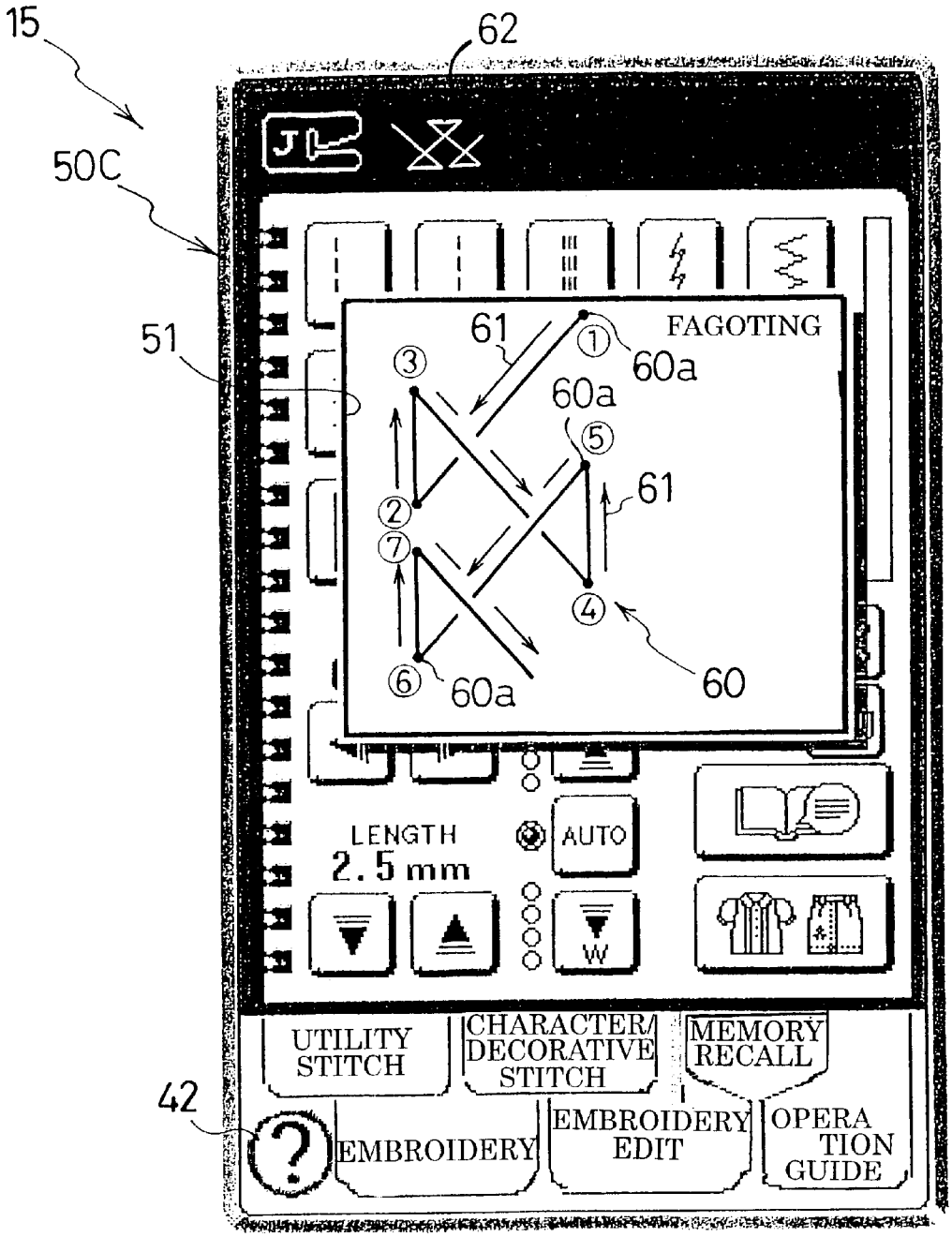
FIG. 10 is a pattern confirmation screen displayed on a display according to a fourth embodiment of the invention.

Referring now to FIG. 10, a fourth embodiment of the invention will be described.

The sewing order display routine in the first embodiment may be modified such that a plurality of arrows indicating the thread path of enlarged stitches of an essential part, that is a unit pattern of a selected stitch pattern, and a plurality of numbers indicating the order of sewing by tracing a plurality of needle drop positions are displayed. For example, when a fagoting stitch pattern is selected, a plurality of arrows 61 indicating the thread path of enlarged stitches 60 of an essential part, that is, a unit pattern of the fagoting stitch pattern, and a plurality of numbers "1, 2, 3, . . . " added to a plurality of needle drop positions 60*a* are displayed on a pattern confirmation screen 50C as shown in FIG. 10. Accordingly, the sewing order of the fagoting stitch pattern can be displayed clearly. Alternatively, the plurality of arrows 61 may be omitted.

Figure 11:
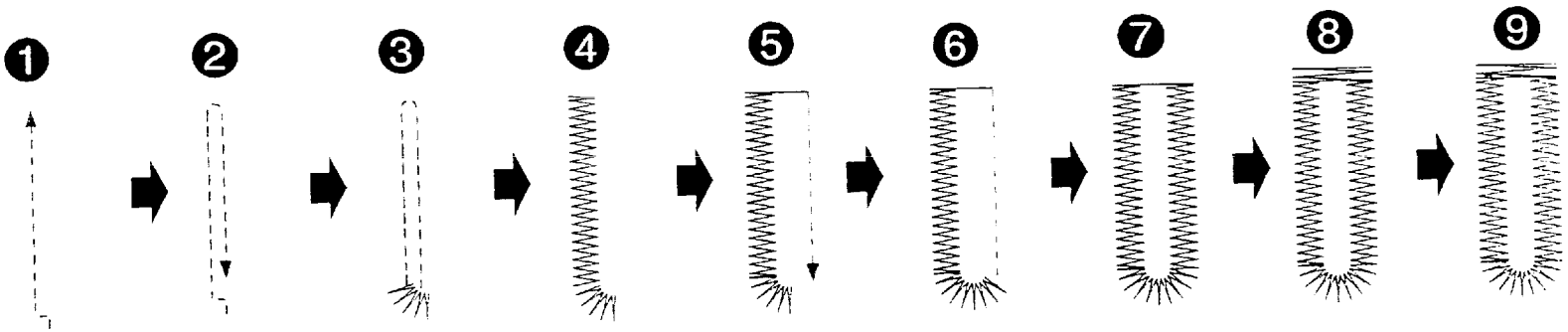
FIG. 11 illustrates a stitch pattern forming process according to fifth and sixth embodiments of the invention.
Figure 12:
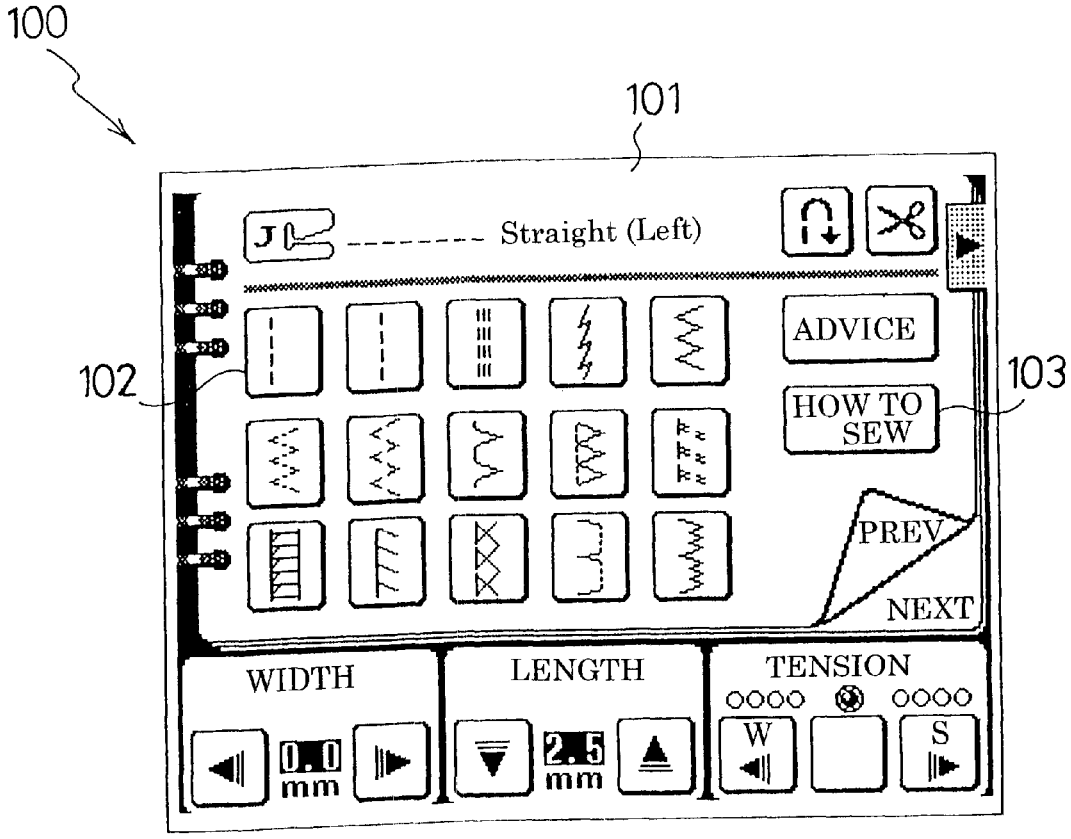
FIG. 12 is a pattern selection screen displayed on a prior art display.

Referring now to FIG. 11, a fifth embodiment of the invention will be described. The sewing order display routine in the first embodiment may be modified such that a forming process of a selected stitch pattern is displayed using an animated picture. For example, following the selection of a buttonhole stitch pattern, or following a predetermined key operation after the selection of a buttonhole stitch, an animated picture as shown in FIG. 11 may be displayed in the pattern display area 51. Although FIG. 11 illustrates the forming process as divided into nine steps, the animated picture is a single continuous picture. Accordingly, the sewing order of the buttonhole stitch pattern can be displayed very clearly.

Alternatively, the sewing order display routine in the first embodiment may be modified such that a forming process of a selected stitch pattern may be displayed in steps using a plurality of frame pictures. For example, following the selection of a buttonhole stitch pattern, or following a predetermined key operation after the selection of a buttonhole stitch, a buttonhole stitch forming process may be displayed in the pattern display area 51 by changing, at predetermined intervals, frame pictures corresponding to each or some of the nine forming steps of FIG. 11. Accordingly, the sewing order of a buttonhole stitch pattern can be displayed very clearly.

Although, in the above-described embodiments, the pattern display program including the pattern display routine, the pattern selection routine, and the sewing order display routine are stored in the ROM 22, it may be stored in the ROM card 7 or in the FD 8. Thereby, the pattern display program stored in the ROM card 7 or the FD 8 can be used in sewing machines with a display, other than the electronically controlled sewing machine M, if they support the use of a ROM card or a FD. A sewing machine using such a ROM card or an FD produces the same effects as the sewing machine M of the above-described embodiments do.

Although not shown, the sewing machine M may be connectable to the internet directly via a modem or a ISDN line or may be connected to a computer, such as a personal computer or server, that stands alone or, in turn, is connected to the internet.

The invention further includes as an aspect, the programs described above that can be executed by the controller of the sewing machine, or by an attached computer, to control the sewing machine as described above. The control program can be implemented in an application specific integrated circuit (ASIC). Alternatively, the control program and/or the stitch data can be transmitted by a carrier wave over a communications network, such as, for example, the World Wide Web, and/or transmitted in a wireless fashion, for example, by radio waves or by infrared waves. The control program can also be transmitted by a carrier wave from a remote storage facility to a local control unit, either in the sewing machine or attached thereto. In such an arrangement, the local control unit interacts with the remote storage facility to transfer all or part of the program or data, as needed, for execution by the local unit. Accordingly, the local unit does not require a large amount of memory capacity. Additionally, or alternatively, the programs can be fixed in a computer-readable recording medium such as, for example, a CD-ROM, a computer hard drive, RAM, or other types of memories that are readily removable or intended to remain fixed within the sewing machine or an attached computer. Thus, as another aspect, the invention relates to a computer program product such as a carrier wave or a recording (or storage) medium that embodies or stores the control program.

While the invention has been described with reference to specific embodiments, it is not restricted to the specific details set forth. Various modifications or changes may be made by those skilled in the art without departing from the spirit and scope of the invention.

What is claimed is:

1. A display apparatus for a sewing machine, comprising:

a single display that displays substantially an entire stitch pattern thereon;

a sewing order indicator that simultaneously indicates a sewing order of each stitch of the substantially entire stitch pattern on the single display; and a selecting device that selects the stitch pattern, wherein the single display displays the stitch pattern selected by the selecting device, and the sewing order indicator indicates on the single display the sewing order of the stitch pattern selected by the selecting device.

2. The display apparatus according to claim 1, wherein the sewing order indicator comprises a sewing direction indicator that indicates a sewing direction at least at a starting portion and an ending portion of the stitch pattern.

3. The display apparatus according to claim 2, wherein the sewing direction indicator comprises a mark display device that displays at least one mark indicating the sewing direction.

4. The display apparatus according to claim 3, wherein the mark display device displays a plurality of marks.

5. The display apparatus according to claim 1, wherein the sewing order indicator comprises a forming process indicator that indicates a forming process of the stitch pattern.

6. The display apparatus according to claim 5, wherein the forming process indicator displays an animation of the forming process.

7. The display apparatus according to claim 5, wherein the forming process indicator displays each picture included in a series of pictures showing the forming process one by one at intervals of a predetermined period.

8. The display apparatus according to claim 1, wherein the sewing order indicator comprises a thread path indicator that indicates a thread path for at least one part of the stitch pattern.

9. The display apparatus according to claim 8, wherein the thread path indicator comprises a mark display device that displays at least one mark indicating the thread path.

10. The display apparatus according to claim 8, further comprising a needle drop position display device that displays needle drop positions included in the stitch pattern.

11. The display apparatus according to claim 10, further comprising an enlargement device that enlarges the stitch pattern on the display.

12. The display apparatus according to claim 10, further comprising a needle drop position numbering device that displays a plurality of numbers indicating an order of the needle drop positions.

13. The display apparatus according to claim 8, wherein the thread path indicator comprises a path numbering device that displays a plurality of numbers indicating an order of the thread path.

14. The display apparatus according to claim 8, wherein the thread path indicator indicates the thread path for at least one unit of repeated patterns included in the stitch pattern.

15. The display apparatus according to claim 8, wherein the thread path indicator indicates the thread path so that when two stitches cross each other, a lower stitch is not displayed in a vicinity of an upper stitch.

16. A method for displaying sewing patterns on a sewing machine display, comprising:

displaying at least a significant portion of a sewing pattern on the display;

displaying a pattern selection screen on the display; and selecting a sewing pattern from sewing patterns displayed on the pattern selection screen, wherein the displayed significant portion of the sewing pattern includes a concurrently displayed sewing order indicator for the stitches of the sewing pattern.

17. The method according to claim 16, further comprising selecting help prior to the selecting of a sewing pattern.

18. The method according to claim 16, wherein the display of at least a significant portion of the selected pattern includes the required stitches and the sewing order indicator for the stitches.

19. The method according to claim 18, wherein the sewing order indicator is comprised of arrows showing a direction of stitching.

20. The method according to claim 18, wherein the sewing order indicator is a number assigned to, and displayed adjacent to, each stitch.

21. The method according to claim 20, wherein the sewing order indicator further includes a direction arrow adjacent each stitch.

22. The method according to claim 18, wherein the sewing order indicator is a number assigned to, and displayed next to, each needle drop position.

23. The method according to claim 22, wherein the sewing order indicator further includes a direction arrow adjacent each stitch.

24. The method according to claim 18, wherein the sewing order indicator is a plurality of screen displays successively showing development of the sewing pattern, the successive screens being presented in one of a continuous mode to provide a motion picture effect and a discrete mode by pausing at each screen.

25. A memory medium containing routines for displaying sewing patterns on a sewing machine display, comprising:

a routine of displaying at least a significant portion of a sewing pattern on the display;

a routine for displaying a pattern selection screen; and a routine for selecting a sewing pattern from a plurality of sewing patterns displayed on the pattern selection screen, prior to displaying the sewing order indicator for the stitches, wherein the routine for displaying the sewing pattern includes a sub-routine for simultaneously displaying a sewing order indicator for stitches of the sewing pattern.

26. The memory medium according to claim 25, further comprising a routine for selecting help prior to executing the routine of selecting a sewing pattern.

27. The memory medium according to claim 25, wherein the routine for displaying at least a significant portion of the selected pattern includes presenting required stitches and including the sewing order indicator of the sewing order for the stitches.

28. The memory medium according to claim 27, wherein the sewing order indicator is comprised of arrows showing a direction of stitching.

29. The memory medium according to claim 27, wherein the sewing order indicator is a number assigned to, and displayed adjacent to, each stitch.

30. The memory medium according to claim 29, wherein the sewing order indicator further includes a direction arrow adjacent each stitch.

31. The memory medium according to claim 27, wherein the sewing order indicator is a number assigned to, and displayed next to, each needle drop position.

32. The memory medium according to claim 31, wherein the sewing order indicator further includes a direction arrow adjacent each stitch.

33. The memory medium according to claim 27, wherein the sewing order indicator is a sub-routine for producing a plurality of screen displays successively showing development of the sewing pattern, the successive screens being presented in one of a continuous mode to provide a motion picture effect and a discrete mode by pausing at each screen.

* * * * *